US005498000A

United States Patent [19]

Cuneo

[11] Patent Number: 5,498,000

[45] Date of Patent: Mar. 12, 1996

[54] GOALTENDER SIMULATOR SYSTEM

[76] Inventor: Gregory Cuneo, 49 Balcom St., Mansfield, Mass. 02048

[21] Appl. No.: 425,033

[22] Filed: Apr. 17, 1995

[51] Int. Cl.[6] ..... A63B 69/00

[52] U.S. Cl. ..... 273/354; 273/85 R; 273/85 G; 273/411; 273/407

[58] Field of Search ..... 273/85 R, 85 G, 273/126 R, 126 A, 57.2, 354, 411, 407

[56] References Cited

U.S. PATENT DOCUMENTS

| | | | |
|---|---|---|---|
| 3,765,675 | 10/1973 | DiMarzio | 273/126 A X |
| 3,794,318 | 2/1974 | Holmes | 273/354 X |
| 3,887,181 | 6/1975 | Samaras | 273/354 X |
| 4,168,062 | 9/1979 | McCarthy et al. | 273/85 R X |
| 4,489,940 | 12/1984 | Amundson . | |
| 4,699,386 | 10/1987 | Carzino | 273/354 |
| 5,333,874 | 8/1994 | Arnold et al. . | |

FOREIGN PATENT DOCUMENTS

| | | | |
|---|---|---|---|
| 2684890 | 6/1993 | France | 273/85 R |

*Primary Examiner*—Raleigh Chiu
*Attorney, Agent, or Firm*—Barlow & Barlow, Ltd.

[57] ABSTRACT

A goaltender simulator system, which closely simulates shooting on a goal tended by a live goaltender, is provided. The system includes a digital video camera which tracks the trajectory of the object launched toward the goal. The continuous image data is filtered to enable a computer control to accurately determine the trajectory of the object as well as estimate its anticipated trajectory. Knowing the anticipated trajectory of the object, the computer control instructs motors to move the goaltender figure and/or its arms to the appropriate position to block the incoming object in an attempt to prevent it from entering the goal.

27 Claims, 6 Drawing Sheets

GOALTENDER SIMULATOR SYSTEM

BACKGROUND OF THE INVENTION

The present invention relates generally to a complete system for simulating a sports goaltender. More specifically, the present invention relates to a system for simulating a sports goaltender which enables a player to experience shooting on a goal where the goaltender closely simulates the movement and reaction of a live goaltender.

Over the years, various sports have become popular which require players to shoot on a goal, which is attended by a goaltender, in an effort to score a point. These sports include, but are not limited to ice hockey, street hockey, lacrosse and soccer. In each of these sports, for example, players are faced with the challenge of shooting the puck or ball past the goaltender and into the opposing team's goal to score a point.

There have been many attempts in the prior art to simulate such a challenge but without the use of a human or live goaltender. For example, U.S. Pat. No. 4,168,062, issued to McCarthy et al., discloses an automated goaltender with a body fixed to a frame and a pair of arms pivotedly connected to the goaltender body which are moveable between various positions through a motorized arrangement. This automated goaltender is placed in front of a goal where its arms move about to increase the challenge of scoring a goal for the shooting player. In addition, U.S. Pat. No. 4,489,940, issued to Amundson, discloses a practice goaltender which includes a goaltender figure mounted on a moveable support base for placement in front of a goal. The goaltender is stationary to permit the shooting player to practice certain shots. Similarly, U.S. Pat. No. 3,765,675, issued to DiMarzio, discloses a simulated hockey goaltender where the goaltender figure moves back-and-forth in a continuous and steady fashion in front of the goal to enhance the challenge of scoring a goal for a shooter. Also, U.S. Pat. No. 4,699,386, issued to Carzino, discloses a soccer practice machine with an array of sensors to determine the horizontal location of the ball as shot. In response to the horizontal location, a goaltender is moved accordingly.

Known prior art goaltender simulator systems fail to closely simulate the actual experience of shooting a ball or puck at a goal tended by a live goaltender. Each of these prior art apparatuses suffer various disadvantages which cause them to poorly simulate an actual shot on a tended goal. For example, various prior art apparatuses are stationary and do not react whatsoever to the particular trajectory of the puck or ball shot. In addition, these prior art apparatus typically include a goaltender which has a regular, continuous and predictable pattern of motion in front of the goal. As a result, the challenge of scoring a goal is severely diminished. Further, prior art systems, which react according to the location of the shot by a player, are severely inadequate to truly simulate the actual experience of taking a shot on a tended goal. These prior art systems fail to accurately track the trajectory of the ball or puck which results in a goaltender reaction which is simple as well as inaccurate.

Goaltender simulator systems have particular application in the entertainment industry where the system can be employed at various entertainment centers, such as family fun centers, sports bars, game rental shops and other similar locations and may also be used as a practice device. There is a demand for a goaltender simulator system which may be used both indoors and outdoors and can be easily operated in an automated fashion. Further, it is desired that the system be impervious to weather conditions to permit outdoor use at locations such as mini-golf courses, batting cages, and similar locations. In particular, it is desirable that such a system closely simulate the experience of shooting on a tended goal which includes the physical challenge of scoring the goal as well as an accompanying audio and visual experience.

SUMMARY OF THE INVENTION

The present invention preserves the advantages of prior art goaltender simulator systems. In addition, it provides new advantages not found in currently available systems and overcomes many of the disadvantages of such currently available goaltender simulator systems.

The invention is generally directed to a novel and unique goaltender simulator system with particular application in closely simulating the actual experience of shooting a puck or ball on a tended goal as experienced in hockey, soccer, lacrosse, and the like. The goaltender simulator system of the present invention is easy to assemble, is modular, requires little supervision during operation, and is easy to modify in accordance with the operator's specifications.

The preferred embodiment of the present invention includes a launch/play area from which an object, having a predetermined color, can be accelerated. The object is preferably a ball for ease of use, but may be other configurations as well. A goal is provided a distance from the launch/play area in the direction of travel of the ball. A goaltender figure is positioned in front of the goal where the goaltender is capable of moving in front of the goal. A camera is positioned, preferably in the chest of the goaltender, to view the travel of the ball. The data received by the camera is filtered to leave images which only include the colors of the ball. The camera continuously takes images of the flight of the ball towards the goal. The continuous supply of filtered images are processed by a computer control which generates the trajectory data of the ball toward the goal. The computer control estimates the terminal position of the ball at the goal area. In response to the determination of the estimated terminal position of the ball, the computer control instructs various motors to move the goaltender figure into place as well as moving various appendages of the goaltender figure into the appropriate positions as required. The goaltender reacts in accordance with the particular flight trajectory of each ball launched toward the goal in an attempt to block and prevent the ball from entering the goal.

Various components, including coin box control, arm movement of the goaltender, speaker and display, are optional components and operate as follows. In operation, a player inserts a predetermined fee into a coin box to initiate the play cycle of the system. A timer starts which represents the time period of play allotted for the predetermined fee. A player launches an object, such as a ball or puck, toward the goal in an attempt to score a goal. The camera monitors the flight trajectory, the computer control processes the information to instruct the goaltender to move accordingly. Goals scored are visually displayed. An audible alert may also be sounded to indicate that a goal has been scored. When the predetermined time period has ended, the system will restart. In addition, the system will restart if a player gets too close to the goaltender.

It is therefore an object of the present invention to provide a goaltender simulator system which closely simulates the experience of shooting on a goal tended by a live goaltender.

Another object of the present invention is to provide a goaltender simulator system which enhances the experience of playing against a simulated goaltender.

It is a further object of the present invention to provide a goaltender simulator system that is easy to assemble and modular in design to permit simple and easy customization.

It is yet a further object of the present invention to provide a goaltender simulator system which is easily adaptable to any sport which employs a goal tended by a goaltender.

It is another object of the present invention to provide a goaltender simulator system which is inexpensive, and easy to assemble, operate and maintain.

BRIEF DESCRIPTION OF THE DRAWINGS

The novel features which are characteristic of the present invention are set forth in the appended claims. However, the inventions preferred embodiments, together with further objects and attendant advantages, will be best understood by reference to the following detailed description taken in connection with the accompanying drawings in which:

DETAILED DESCRIPTION OF THE PREFERRED EMBODIMENT

Figure 1:
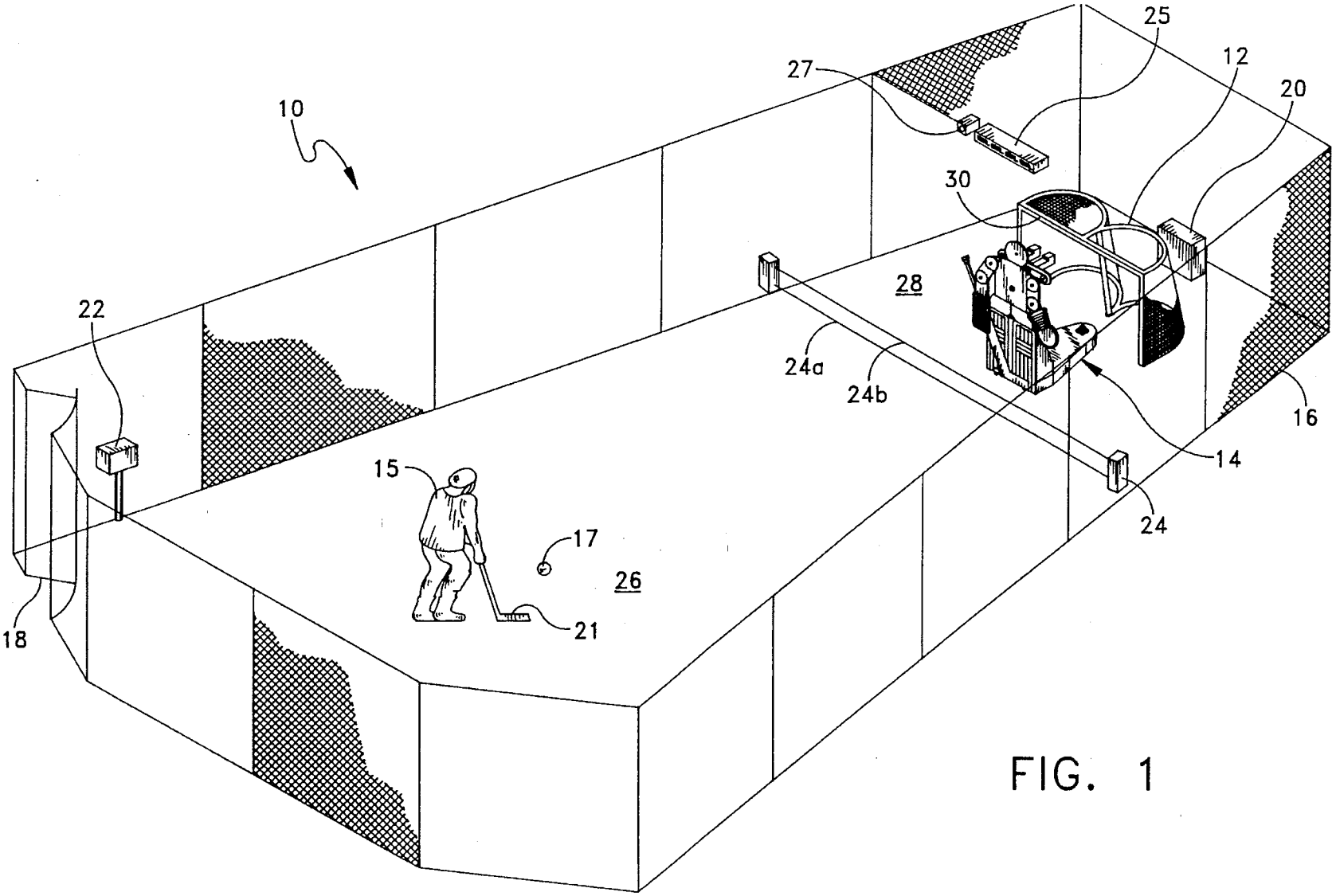
FIG. 1 is a perspective view of the goaltender simulator system of the present invention.

Referring to FIG. 1, a perspective view of the goaltender simulator system 10 of the present invention is shown. A goal 12 is provided with a goaltender FIG. 14 position in front thereof. Netting enclosure 16 completely encloses goaltender FIG. 14 and goal 12. Infrared sensors 24 includes a pair of transmitters and a pair of receivers to create a pair of sensor lines 24*a* and 24*b* which are preferably approximately 15 inches apart from one another. These two infrared sensors are used to separate the space within netting 16 into a play area 26 and a restricted area 28. The ground surface in restricted 28 is preferably sloped at a 3° angle towards play area 26 to allow a ball present in the restricted area to roll back to the shooting player for continuous play. Other methods may be used to return balls or pucks to the player such as automated retrieval devices. The shooting player can stickhandle, dribble, or shoot from any location within play area 26.

Referring specifically to infrared sensors 24, two sets of a transmitter and receiver will be spaced approximately 15 inches apart, one on top of the other inside netting 16. Each box 24 preferably consists of one transmitter and one receiver unit to avoid crosstalk that could result when two receivers or two transmitters are housed in the same unit. The use of two sensors, with sensor beams 24*a* and 24*b*, are required because one beam could be broken by the ball or playing stick 21 from a shot taken. The use of two beams ensures error free sensing of a player's body when it traverses through both beams 24*a* and 24*b* simultaneously. The use of infrared sensors 24, to restrict player access to restricted area 28, is important for safety reasons as well as proper operation of the system of the present invention. Since goaltender 14 will move back and forth and its arms will move up and down, as will be discussed in detail below, it is important that a player keep a sufficient distance away from the goaltender to prevent injury. Further, the challenge of play and correct operation of the system would severely be diminished if a player were permitted to shoot from a position extremely close to goal 12. As a result, goaltender 14 could not possibly react in time to give the player 15 a sufficient challenge. As will be discussed in detail below, if both beams 24*a* and 24*b* are broken simultaneously, the game will preferably be terminated under the assumption that player 15 has entered into restricted area 28. Alternatively, all functions could be disabled until player 15 returns to the play area 26.

Figure 2:
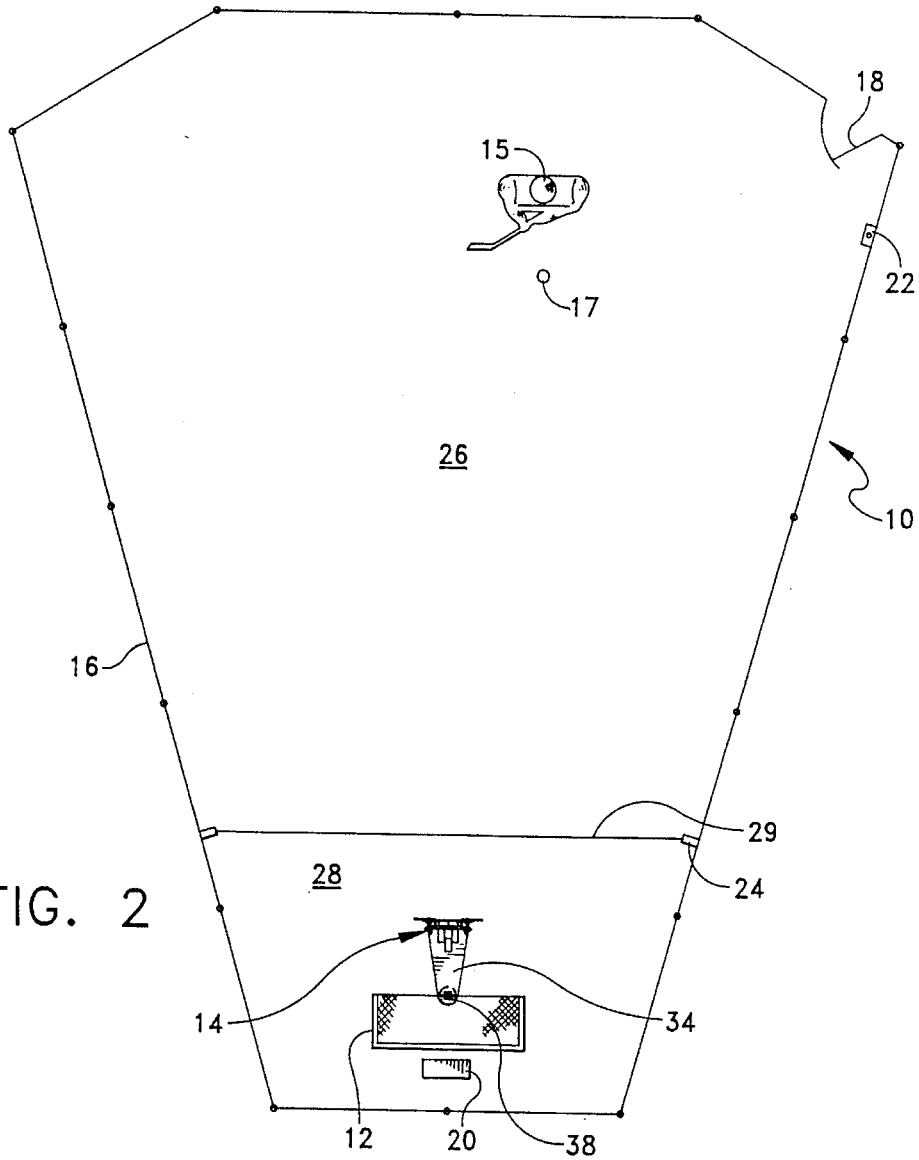
FIG. 2 is a top view of the goaltender simulator system of FIG. 1.
Figure 3:
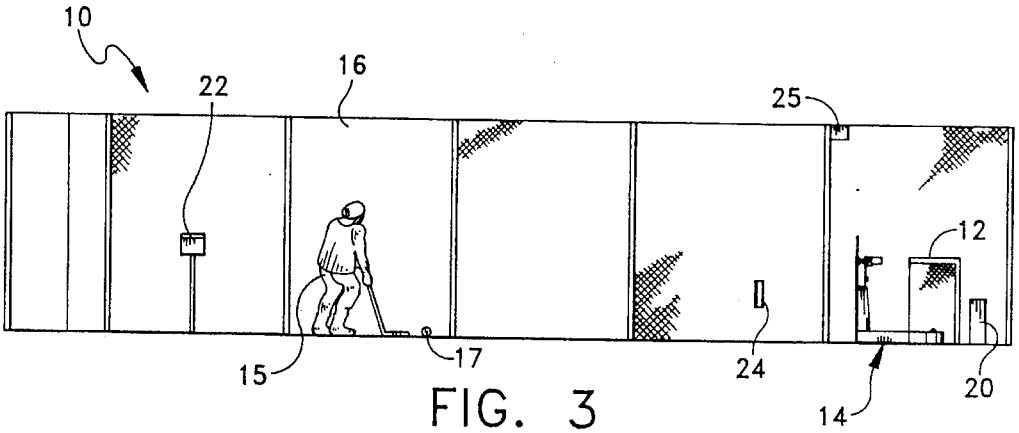
FIG. 3 is a right side view of the goaltender simulator system of FIG. 1.

As seen in FIGS. 1–3, a coin box and timer are provided directly inside netting enclosure 16 proximal to door 18 which permits entry into play area 26. Coin box and timer 22 provide a way for the operator of the goaltender simulator system to charge a fee for its use. The individual desiring to use the system 10 of the present invention is required to put in a predetermined fee into the coin box. This will in turn activate system 10 thus activating all of the components and functions of the game. Upon receiving the correct fee, which can be adjusted by the operator, the timer will be activated which will begin the countdown of a predetermined play period. Within this predetermined allotted time, the player 15 attempts to shoot ball 17 into goal 12 past goaltender 14 as many times as he or she can. For example, a preferred period of play is in the range of 60–90 seconds but may be adjusted as desired and may include a complete override which will suppress the requirement of inserting a fee to play the game.

As seen in FIGS. 1–4, a visual display 25 and speaker 27 are provided to enhance the overall experience of using the system 10 of the present invention. In particular, display 25 is preferably a digital display which is programmable as desired. For example, a predetermined sequence of messages may be programmed into visual display 25 to entice individuals to use the goaltender simulator system 10. In addition, visual display 25 is preferably programmed with a predetermined sequence of messages that will be displayed upon certain inputs. For example, when a goal has been scored, the visual display 25 will display "GOAL" and then register that a goal has been scored and display the number of goals scored thus far. Scoring will be on a cumulative basis for the given time allotted per game. As a result, individuals may compete against one another to see who can score the most goals.

In addition, to further enhance game play, a speaker 27 is provided which plays prerecorded messages in accordance with certain events. For example, a prerecorded message of a crowd cheering and an announcer yelling "GOAL" is preferably employed. Such an audio visual enhancement to the system 10 of the present invention is effective in drawing attention to the activity within the simulator system 10. Also, it is also desirous for the speaker 27 to broadcast messages near the end of the allotted time to alert the player that his or her time period of play is close to expiring. For example, the message could count down the final ten seconds of the period of game play.

FIG. 2 illustrates a top view of the goaltender simulator system 10 of the present invention. Netting 16 preferably forms a play area 26 which is relatively wide towards the rear region near door 18. Play area 26 preferably narrows as it approaches goal 12. Play area 26 may vary and be of different configurations depending upon the particular installation and the particular sport to which the present invention is applied. For example, it may be more desirable to have a larger area should the sport being simulated is soccer. Similarly, it may be desirable to have a smaller play area 26 should the system 10 be installed indoors where space is at a premium. Referring now to FIG. 3, a right side view of the present invention 10 is shown. Netting 16 may be of varying heights and configurations in accordance with the particular installation. For example, an outdoor installation may require additional netting above the head of player 15 to prevent balls 17 from flying out of netting enclosure 16.

Figure 4:
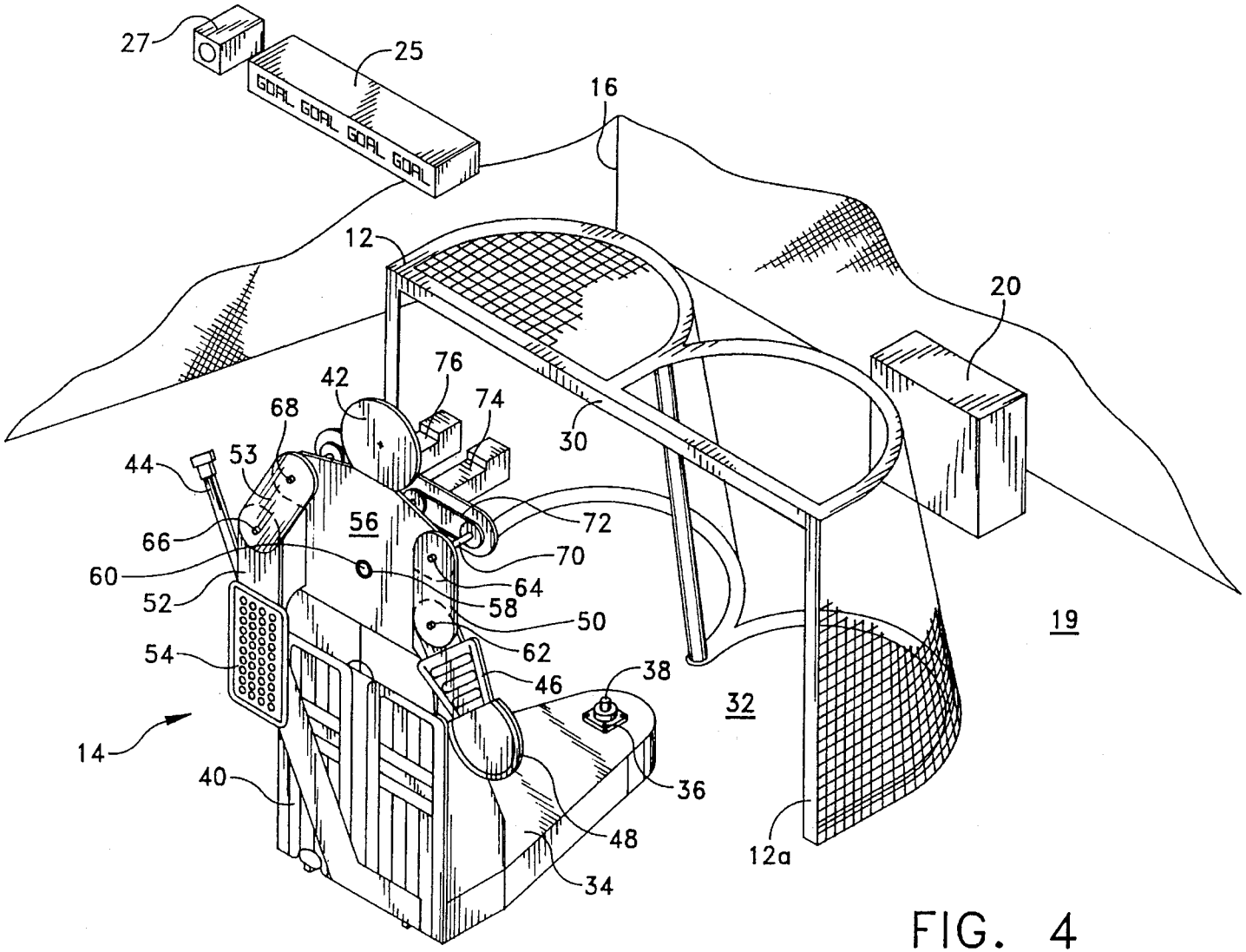
FIG. 4 is a perspective view of a close-up of the goaltender and goal shown in FIG. 1.
Figure 5:
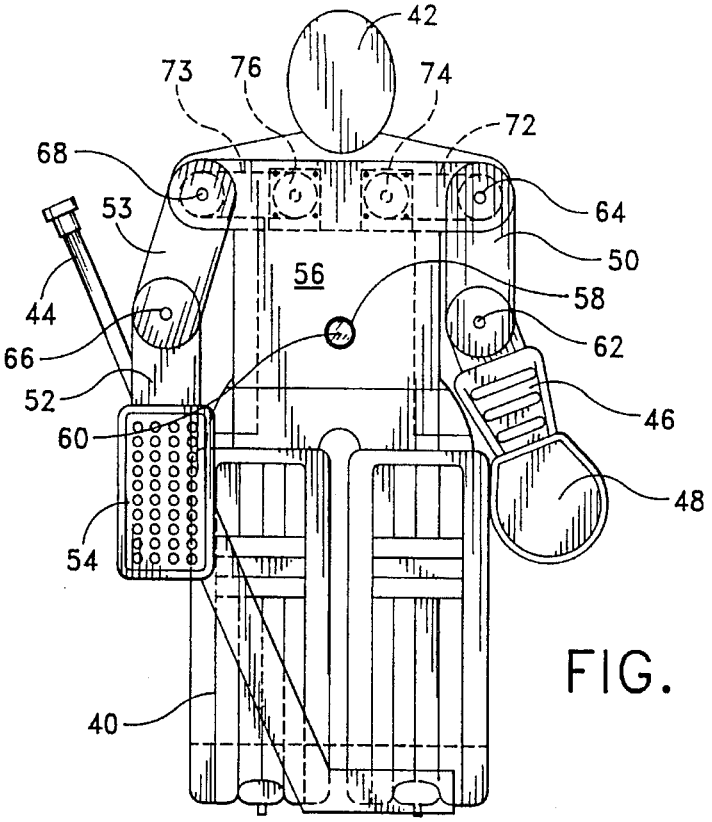
FIG. 5 is a front view of the goaltender of FIG. 4.
Figure 6:
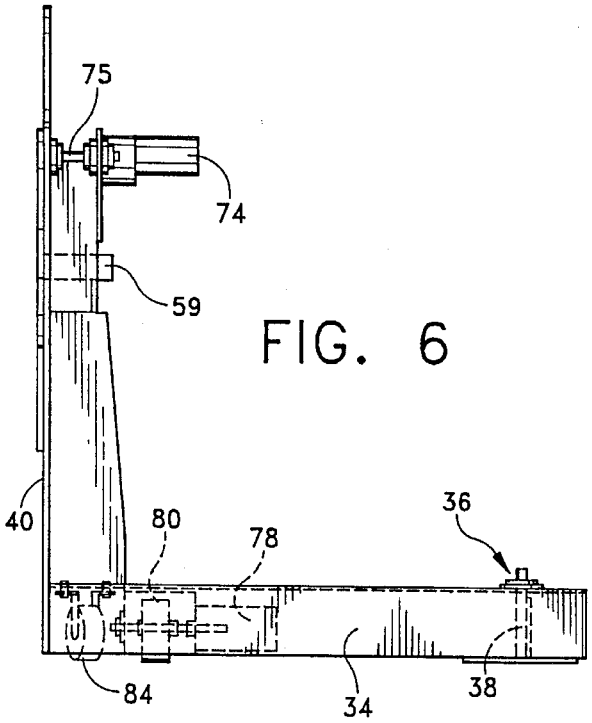
FIG. 6 is a right side view of the goaltender of FIG. 4.

FIGS. 4–7 illustrate the structure and assembly of goaltender 14 in accordance with the present invention. Referring to FIGS. 4–6, the various components of goaltender 14 can be seen. Goaltender 14 includes a base 34 with a body 40 connected thereto at an approximate 90° angle. Head portion 42 is included at the uppermost portion of body 40. A pair of arms are connected to body 40 along with the appropriate components and visual effects to provide a goaltender FIG. 14 which has the overall appearance, size and configuration of an actual human goaltender. Left upper arm 50 is pivotally connected at left shoulder pivot 64. Left forearm 46 is pivotally connected to upper arm 50 at left elbow pivot 62. A simulated glove 48 is provided on the free end of left forearm 46 to further enhance realism. Right upper arm 53 is pivotally connected to the goaltender body 40 at right shoulder pivot 68. Right forearm 52 is pivotally connected to right upper arm 53 at right elbow pivot 66. A simulated goaltender pad 54 is provided on the free end of right forearm 52 to enhance realism. In addition, a simulated goaltender stick is provided to further enhance realism.

Goaltender 14 is pivotally connected to the ground 19, as best seen in FIG. 4, via anchor shaft 38 and pivot assembly 36. As a result, goaltender 14 may pivot in front of goal 12 about anchor shaft 38. The control of such pivoting will be discussed in more detail below. Camera aperture 58 is present through chest 56 of goaltender 14 to permit camera lens 60 to be exposed to play area 26 and ball 17.

Referring now to FIGS. 4–7, the motorized control of the arms of goaltender 14 and the pivot movement about anchor shaft 38 can be seen. Motor 74 is provided to rotate shaft 75 to drive belt 72 to in turn rotate shaft 70 to pivot left upper arm 50. Motor 76 is similarly connected to a shaft (not shown) to drive belt 73 to rotate right shoulder pivot 68 to move right upper arm 53. Motors 74 and 76 are preferably digital stepper motors to accurately control the pivoting of the arms. Alternatively, pneumatic actuators may be employed. Movement control is not provided at elbow pivot points 62 and 66, however, additional mechanics may be provided to further move goaltender 14 at these additional points. Both the left and right arms have their own motors 74 and 76 to achieve independent movement from one another. This is particularly useful where the simulator system of the present invention is simulating a hockey goaltender. This permits the goaltender's left arm, for example, to move independently of the right arm thereby simulating a glove save. Alternatively, in a soccer version, it is preferred that the arms move simultaneously to simulate a soccer goaltender's common position with both of his or her arms over the head. As will be discussed in detail below in connection with the computer control of the present invention, motors 74 and 76 will be employed as needed to move the appropriate appendage of the goaltender 14 to the appropriate spot to block the ball 17 from entering goal 12. Such arm movement provides the goaltender with the ability to vertically block a goal in addition to horizontal blocking via pivot assembly 36.

Figure 7:
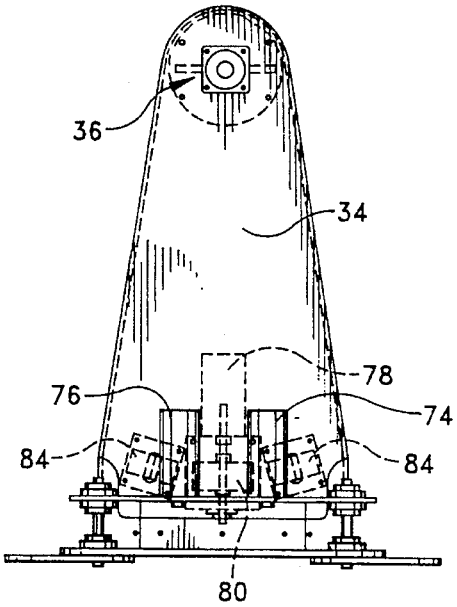
FIG. 7 is a top view of the goaltender of FIG. 4.

Most importantly, goaltender 14 has the ability to move in a horizontal direction to block shots from player 15. Pivot motor 78 is provided to drive tire 80 which is in contact with the ground. Pivot motor 78 drives tire 80 to pivot goaltender 14 about anchor shaft 38 at base 34. A pair of fixed wheels 84 are provided, as best seen in FIG. 7, to ensure that goaltender 14 smoothly pivots about anchor shaft 38. Similar to motors 74 and 76, pivot motor 78 is preferably a digital stepper motor to accurately control the pivot movement of goaltender 14 about anchor shaft 38.

In use, the goaltender 14 will be required to continuously center itself between the posts **12*a* of goal 12. The pivot stepper motor 78 is located in base 34. Pivot motor 78 directly drives the six inch semi-pneumatic tire 80 that will rotate goaltender 14 into the correct position as instructed by the computer control. The rear end of base 34 is mounted with a pivot assembly bearing 36 that is mounted directly into the ground via anchor shaft 38. Due to slippage of the six inch semi-pneumatic drive tire 80, the stepper pivot motor 78 must be recalibrated to a known position to prevent the goaltender 14 from crashing into goal post 12*a* of goal 12. This will be accomplished by incorporating into the anchor shaft assembly 38 a small set of sensors (not shown), preferably optical or infrared, which are centrally located on goaltender base 34 with a mating portion of the sensor (not shown) attached to the ground. As a safety precaution, limit switches (not shown) may be placed on the pivot assembly 36 to define the maximum allowable arc the goaltender 14** can pivot through. If a limit switch is tripped, rotation in that direction will be ceased immediately.

Referring to FIGS. 4–6, a video camera 59 is preferably mounted behind the chest 56 of goaltender 14 with its camera lens 60 exposed through video camera aperture 58. Video camera 59 is preferably a digital video camera with a frame rate of 30 frames per second and a shutter speed of 1/10,000 of a second. Such a shutter speed permits the video camera to operate with standard lighting.

As shown in FIGS. 1–4, a computer control 20 is provided. Computer control 20 is connected to each of the components of the goaltender simulator system 10 of the present invention. Most importantly, computer control 20 is connected to stepper motors 74, 76, and 78 to control the full range of movement of goaltender 14. In addition, computer control 20 is connected to video camera 59 for the processing of images received and the operation of motors 74, 76 and 78 in response thereto.

Computer control 20 is preferably a personal computer, such as a 486–25 MHz computer with the appropriate image processing hardware and software as well as the appropriate sound hardware and software (not shown). In addition, computer control 20 is preferably encased in a climate controlled housing to protect it from the weather. The computer control 20 includes hardware and software components which are responsible for processing all of the information required to run the system. The computer component (not shown) of computer control 20 preferably uses readily available printed circuit board assemblies which are needed to process the required information. For example, an OCULUS f/64 frame grabber printed circuit board, a digital I/O PCA and a SOUND BLASTER kit may be employed as components of the computer control 20. While these components are preferred, other components may be employed as well.

Custom software is preferably employed to operate each of the components of the computer control 20. Each of the components of the system 10 may be controlled by such software. The software code is preferably written in "C" which permits the configuration to easily be altered in response to the addition, removal or modification of any system components.

The computer control 20 provides the control to cause the goaltender 14 to react, "on the fly," to a ball accelerating toward it. To accomplish this, video camera 59, as discussed above, is housed behind the chest 56 of goaltender 14. The location of video camera 59 enables it to view the trajectory of the ball 17 as it comes from player 15 and travels toward goal 12. This camera tracks the trajectory of ball 17. It is preferred that in a PULNIX TM-745i ⅔ with an auto iris function be employed as video camera 59 to ensure that ball 17 is tracked properly. Video camera 59, at a rate of 30 frames per second, sends information to computer control 20 concerning the array of colored pixels viewed. An optical filter is employed, which matches the optical wavelength color of ball 17 to permit the camera and the resultant data sent to computer control 20 to be free of colors other than the color of ball 17. As a result, video camera 59, via a color filter which is incorporated into computer control 20, provides computer control 20 with a continuous stream of information concerning the ball 17 traveling towards goal 12. In particular, computer control 20 continuously analyzes the data received from video camera 59 and determines the location of ball 17 on the images received by counting the number of individual pixels in the X and Y directions to the center of ball 17. As a result, the precise location of ball 17 in the X and Y directions can be determined for each frame transmitted to computer control 20.

Figure 9:
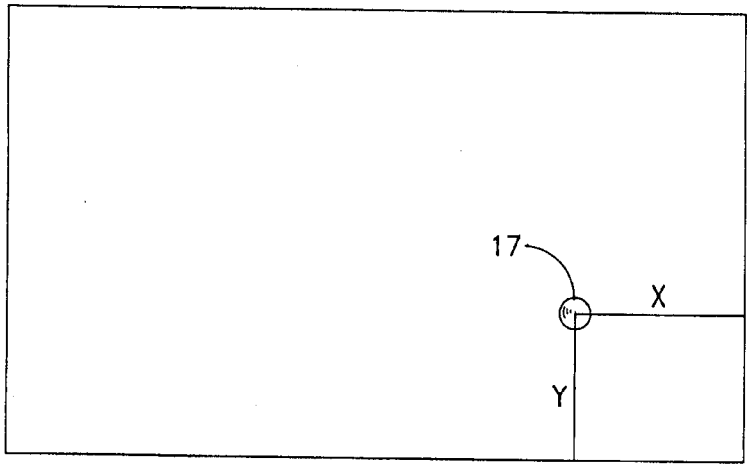
FIG. 9 is a first image in a sample sequence of images retrieved by the camera in accordance with the present invention.
Figure 10:
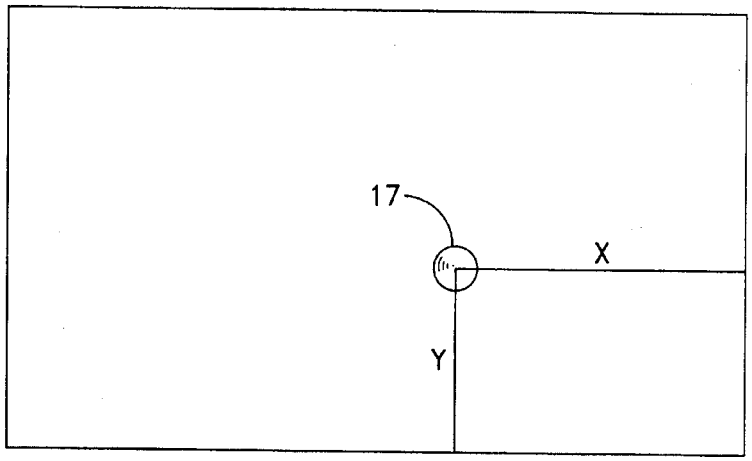
FIG. 10 is a second image in a sample sequence of images retrieved by the camera in accordance with the present invention.
Figure 11:
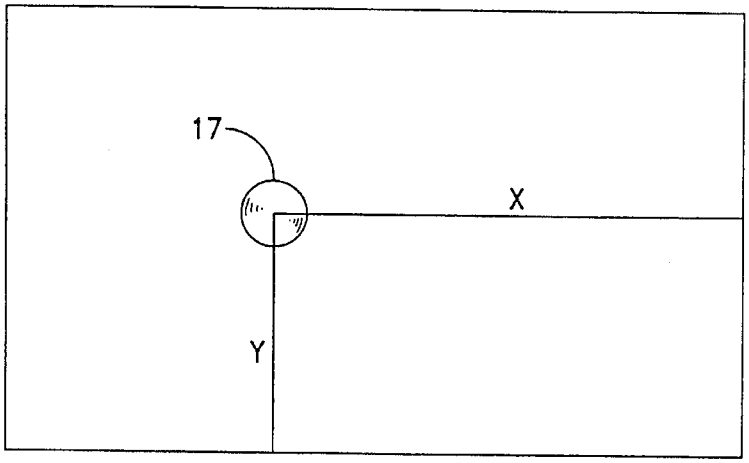
FIG. 11 is a third image in a sample sequence of images retrieved by the camera in accordance with the present invention.

The position of ball 17 in the X direction and how close the ball 17 is to goaltender 14, can be determined through further processing of the images received by computer control 20. As stated above, the X and Y positions of ball 17 are determined by essentially marking the central position of the image of ball 17. The closeness of ball 17 to goaltender 14 is determined by counting the number of pixels of the ball 17 in each successive image. For example, as the ball 17 gets closer to goaltender 14, it will appear larger in the image transmitted by video camera 59. Turning to FIGS. 9–11, an example of three successive filtered images from video camera 59 to computer control 20 is shown. FIG. 9 illustrates a frame transmitted by video camera 59 where ball 17 is relatively small and in the lower right hand corner of the image. This represents that the ball 17 is relatively far away and low to the ground. FIG. 10 shows ball 17 being larger and close to the center of the image which represents that ball 17 is even closer to goaltender 14 and is elevating off the ground. FIG. 11 illustrates ball 17 being relatively large and in the middle of the image which represents that ball 17 is very close to goaltender 14 and is moving across play area 26 and elevating at the same time. With computer control 20 knowing the X and Y locations of ball 17 and the size of ball 17 over time, the trajectory can be determined. Essentially, the anticipated trajectory of the ball may be estimated indicating where the goaltender 14 should be to make an attempt to prevent the ball 17 from entering goal 12. Further, location of ball 17 in goal 12, resulting in a score, can be determined using the same technique.

Once computer control 20 calculates and then estimates the anticipated trajectory of ball 17, it instructs stepper motors 74, 76 and 78 to move accordingly. To achieve this, a digital servo technique is employed which compares the digitally encoded position of the stepper motors 74, 76 and 78 to the horizontal and vertical digital counter outputs derived from video camera 59 which represent the position of the ball. The motors are then driven to a zero difference position which will cause the appropriate motor(s) to be engaged to move the appropriate goaltender 14 component to block the shot. As a result, the goaltender 14 continuously tracks and attempts to block every shot of ball 17 towards goal 12. It should be understood that a goal is scored when player 15 surpasses the speed at which goaltender 14 can block the shot. In addition, speed of motors 74, 76 and 78 can be controlled to create various skill levels of play.

Alternatively, a radio frequency (RF) control may be employed. An RF receiver may be positioned in the chest of goaltender FIG. 14 and a corresponding RF transmitter may be encased in ball 17. As ball 17 is launched toward goaltender FIG. 14, the RF receiver may sense the location and, thereby the trajectory, of an incoming ball 17. For example, the strength and location of the RF signal received could be processed by computer control 20 to accurately determine the trajectory of ball 17 to, in turn, move the goaltender 14 accordingly.

To additionally enhance play, a motion detector, such as a PIR-type, is mounted along the crossbar of goal 12, as seen in FIG. 4. As ball 17 passes across the goal line, the movement of ball 17 will be sensed. When this movement has been detected, it will be assumed that a goal has been scored. This method of determining whether a goal is scored is in addition to the trajectory calculation as described above where trajectory travel into the goal 12 itself can be estimated. The use of a motion detector to determine whether a goal has been scored is important because this occurs behind the view of video camera 59. When a trajectory into goal 12 or motion detector 30 is tripped, computer control 20 will take the appropriate action to indicate that a goal has been scored, such as through indication by display 25 and speaker 27, as seen in FIG. 4. Such dual determination of whether a goal has been scored ensures accuracy in awarding goal points.

Computer control 20 initiates a reset of the system, which includes a reset of all functions of the system back to its original state, when the allotted period of game play has expired or when the two infrared sensors 24 have been simultaneously been tripped, as described above. When the system 10 has been reset, goals scored will not register, the video camera 59 will not be functional, and no visual or audio displays will occur. The goaltender simulator system 10 of the present invention can be restarted by payment of the required fee through coin box 22 or through an operator override.

Figure 8:
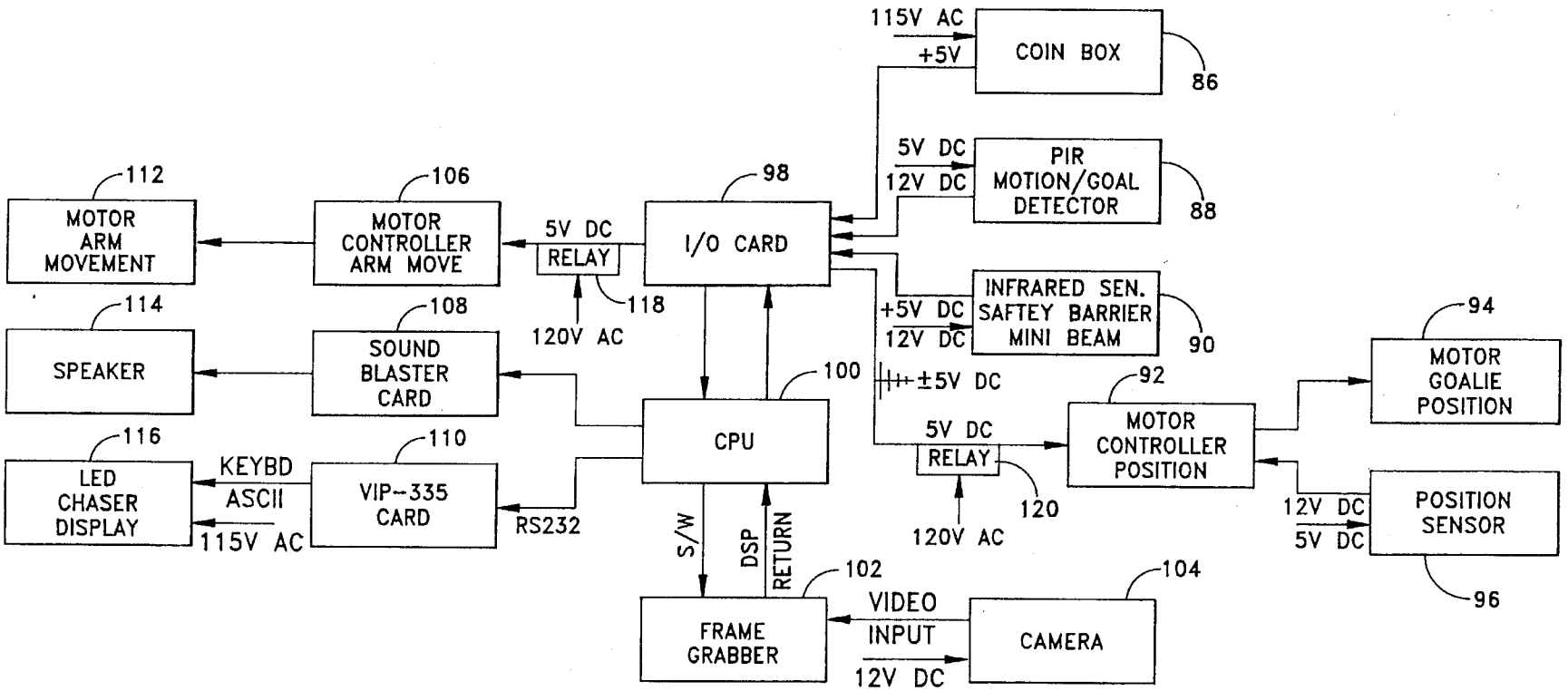
FIG. 8 is a block diagram illustrating the electrical control sequence of the present invention.

FIG. 8 shows a block diagram of the electrical control of the system of the present invention. Coin box 86 initiates the system sequence and starts a predetermined time period of play. Camera 104 provides video input to frame grabber 102 which supplies information to CPU 100 for processing. CPU 100 instructs, via I/O card 98 the appropriate pivot horizontal position by actuating relay 120 to place the motor at the proper position 92 to in turn position the goaltender properly at 94. Position sensor 96 ensures that goaltender 14 does not crash into goal post 12*a*. In the event arm movement is required in an attempt to block a shot, relay 118 will be actuated to engage motor controller 106 to in turn move the arm 112. Throughout operation of the system, card 110 provides an interface to LED display 116 to display visual messages. Similarly, SOUND BLASTER card 108 provides an interface for transmitting audio messages at the speaker 114. In addition, motion/goal detector 88, if tripped, will be processed via I/O card 98 by the CPU 100 to display the appropriate visual message and transmit the appropriate audio signal. Infrared sensor 90 will effectively terminate the session and the CPU will initiate a reset sequence.

It would be appreciated by those skilled in the art that various changes and modifications can be made to the illustrated embodiments without departing from the spirit of the present invention. All such modifications and changes are intended to be covered by the appended claims.

What is claimed is:

1. A goaltender simulator system, comprising:

a launch area from which an object, having a predetermined color, can be accelerated;

a goal distanced from the launch area in the direction of travel of said object;

a goaltender figure positioned in front of said goal;

said goaltender figure being movable in front of said goal;

a camera positioned to view said travel of said object;

said camera including an output signal;

filter means connected to said output signal for filtering out all colors other than said predetermined color of said object to generate a filtered signal; and computer control means electrically connected to said digital camera for receiving said filtered signal to generate object trajectory data to move said goaltender figure into the trajectory of said object.

2. The system of claim 1, further comprising:

frame grabber means for periodically capturing an image of said object during its flight trajectory; a series of images being generated providing trajectory information;

processor means for determining the trajectory of said object based on said series of images; and body movement means connected to said processor means for moving said goaltender figure, in accordance with said trajectory information, to a position in the flight trajectory of said object to prevent said object from entering said goal.

3. The system of claim 2, wherein said goaltender figure is pivotally affixed to the ground and is capable of moving in a horizontal direction.

4. The system of claim 3, wherein said body movement means is a stepper motor.

5. The system of claim 2, further comprising:

a pair of arms each pivotally connected to said goaltender figure and moveable between a substantially vertical position adjacent said goaltender figure and an upper position outwardly extending from said goaltender figure; and a pair of arm movement means connected to said pair of arms, respectively; said arm movement means move said pair of arms between said vertical position and said upper position in response to the trajectory of said object.

6. The system of claim 5, wherein said arm movement means are stepper motors.

7. The system of claim 2, wherein said frame grabber means captures an image of said object during its flight trajectory at a rate of 30 images per second.

8. The system of claim 1, wherein said camera is a digital camera.

9. The system of claim 1, wherein said camera is positioned in the chest of the goaltender figure and directed toward said launch area.

10. The system of claim 1, further comprising:

sensor means for determining whether an a user of the system is too close to the goaltender figure.

11. The system of claim 10, wherein said sensor means is a pair of parallel infrared sensor units spaced apart approximately 15 inches from one another.

12. The system of claim 11, further comprising:

netting enclosing said launch area, said goal and said goaltender figure;

a coin box connected to said computer control means to initiate operation of the system for a predetermined period of time after a fee is paid;

timer means connected to said coin box for counting down said predetermined period of time;

means for resetting the system after said predetermined period of time has expired;

means for resetting the system when both of said infrared sensors are simultaneously tripped;

goal sensing means positioned directly in front of said goal for determining when a goal has been scored;

means for visually displaying when a goal has been scored; and means for audibly indicating when a goal has been scored.

13. A goaltender simulator system, comprising:

a launch area from which an object, having a predetermined color, can be accelerated;

a goal distanced from the launch area in the direction of travel of said object;

a goaltender figure positioned in front of said goal;

said goaltender figure being movable in front of said goal;

a camera positioned to view said travel of said object;

said camera including an output signal;

filter means connected to said output signal for filtering out all colors other than said predetermined color of said object to generate a filtered signal;

computer control means electrically connected to said digital camera for receiving said filtered signal to generate object trajectory data to move said goaltender figure into the trajectory of said object;

frame grabber means for periodically capturing an image of said object during its flight trajectory; a series of images being generated providing trajectory information;

processor means for determining the trajectory of said object based on said series of images; and a first motor means, a second motor means and a third motor means each connected to said processor means; said first motor means pivoting said goaltender figure horizontally in front of said goal; said second motor means moving a first goaltender arm; said third motor means moving a second goaltender arm; said goaltender figure, said first arm and said second arm being moved, in accordance with said trajectory information, to a position in the flight trajectory of said object to prevent said object from entering said goal.

14. A goaltender simulator system, comprising:

a launch area from which an object can be accelerated;

a goal distanced from the launch area in the direction of travel of said object;

a goaltender figure positioned in front of said goal;

said goaltender figure being movable in front of said goal;

detector means for tracking a trajectory of travel of said object; said detector means including an output signal of trajectory data; and computer control means electrically connected to said detector means for receiving said output signal of trajectory data to move said goaltender figure into the trajectory of said object.

15. The system of claim 14, further comprising:

processor means for determining the trajectory of said object; and body movement means connected to said processor means for moving said goaltender figure, in accordance with said trajectory data, to a position in the flight trajectory of said object to prevent said object from entering said goal.

16. The system of claim 15, wherein said goaltender figure is pivotally affixed to the ground and is capable of moving in a horizontal direction.

17. The system of claim 16, wherein said body movement means is a stepper motor.

18. The system of claim 15, further comprising:

a pair of arms each pivotally connected to said goaltender figure and moveable between a substantially vertical position adjacent said goaltender figure and an upper position outwardly extending from said goaltender figure; and a pair of arm movement means connected to said pair of arms, respectively; said arm movement means move said pair of arms between said vertical position and said upper position in response to the trajectory of said object.

19. The system of claim 18, wherein said arm movement means are stepper motors.

20. The system of claim 14, wherein said detector means is positioned in the chest of the goaltender figure and directed toward said launch area.

21. The system of claim 14, further comprising:

sensor means for determining whether a user of the system is too close to the goaltender figure.

22. The system of claim 21, wherein said sensor means is a pair of parallel infrared sensor units spaced apart approximately 15 inches from one another.

23. The system of claim 22, further comprising:

netting enclosing said launch area, said goal and said goaltender figure;

a coin box connected to said computer control means to initiate operation of the system for a predetermined period of time after a fee is paid;

timer means connected to said coin box for counting down said predetermined period of time;

means for resetting the system after said predetermined period of time has expired;

means for resetting the system when both of said infrared sensors are simultaneously tripped;

goal sensing means positioned directly in front of said goal for determining when a goal has been scored;

means for visually displaying when a goal has been scored; and means for audibly indicating when a goal has been scored.

24. A method of tending a goal, comprising the steps of:

providing a goal;

providing a goaltender figure;

launching an object, of a predetermined color, towards said goal;

periodically capturing images of said object in flight;

filtering out of said images all colors other than said predetermined color;

determining position of said object in said images;

determining size of said object in said images;

comparing position and size of said object in said images;

determining trajectory of said object;

estimating a terminal position of said object at said goal;

moving said goaltender figure to said terminal position; and centering said goaltender figure in front of said goal.

25. The method of claim 24, further comprising the steps of:

horizontally pivoting said goaltender figure to said terminal position; and moving an arm of said goaltender figure to said terminal position.

26. The method of claim 24, further comprising the steps of:

receiving a fee to activate a goal tending session;

timing said goal tending session for a predetermined period of time; and resetting said session after said predetermined period of time has expired.

27. The method of claim 24, further comprising the steps of:

sensing when a player is too close to said goaltender figure;

resetting said goal tending session when it is sensed that a player it positioned too close to said goaltender figure;

sensing when a goal has been scored;

visually displaying when goal has been scored; and audibly indicating when a goal has been scored.

* * * * *